US009891567B2

(12) United States Patent
Fukuda

(10) Patent No.: US 9,891,567 B2
(45) Date of Patent: Feb. 13, 2018

(54) IMAGE FORMING APPARATUS

(71) Applicant: CANON KABUSHIKI KAISHA, Tokyo (JP)

(72) Inventor: Tadashi Fukuda, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/211,901

(22) Filed: Jul. 15, 2016

(65) Prior Publication Data

US 2017/0023899 A1 Jan. 26, 2017

(30) Foreign Application Priority Data

Jul. 22, 2015 (JP) ..... 2015-144847

(51) Int. Cl.
*G03G 15/00* (2006.01)
*G03G 21/00* (2006.01)

(52) U.S. Cl.
CPC ..... *G03G 15/50* (2013.01); *G03G 21/0005* (2013.01); *G03G 21/0035* (2013.01); *G03G 2215/0129* (2013.01)

(58) Field of Classification Search
CPC ..... G03G 15/50; G03G 21/0005; G03G 2221/0005
USPC ..... 399/71, 353
See application file for complete search history.

(56) References Cited

U.S. PATENT DOCUMENTS 8,396,383 B2 * 3/2013 Honjoh ..... G03G 15/757 399/44
2007/0212139 A1 * 9/2007 Sugiura ..... G03G 21/0035 399/353
2010/0245945 A1 * 9/2010 Murayama ..... G03G 15/0131 358/498
2010/0272464 A1 * 10/2010 Okamoto ..... G03G 15/161 399/101

FOREIGN PATENT DOCUMENTS

JP 2002-296998 A 10/2002
JP 2005-43806 A 2/2005
JP 2011-39427 A 2/2011
JP 2015-25950 A 2/2015

* cited by examiner

*Primary Examiner* — Sandra Brase
(74) *Attorney, Agent, or Firm* — Canon USA, Inc. I.P. Division

(57) ABSTRACT

An embodiment of an image forming apparatus includes a first image forming unit including a photosensitive drum and a fur brush for cleaning toner on the photosensitive drum and a second image forming unit including a photosensitive drum and a fur brush for cleaning toner on the photosensitive drum. In at least one embodiment for image formation, the fur brush in the first image forming unit and the fur brush in the second image forming unit start at different timings.

42 Claims, 8 Drawing Sheets

IMAGE FORMING APPARATUS

BACKGROUND OF THE INVENTION

Field of the Invention

The present disclosure relates to an electrophotographic image forming apparatus.

Description of the Related Art

An electrophotographic image forming apparatus uniformly charges a surface of an image-bearing member, such as a photosensitive drum, by charging means, then exposes it to form an electrostatic latent image, develops the electrostatic latent image with coloring toner, and forms a visible image (toner image). Then, the image forming apparatus transfers the formed toner image to a recording medium, such as a sheet of paper, directly or with an intermediate transfer member or other member disposed therebetween. Foreign matter remaining on the image-bearing member after the transfer, such as toner, is cleaned (removed) by a cleaning device, such as a cleaning blade. One known example of the cleaning device may be a configuration that uses a cleaning rotator, such as a fur brush, for cleaning foreign matter on the image-bearing member by rotating itself and rubbing the image-bearing member (Japanese Patent Laid-Open No. 2011-39427).

In a configuration in which a plurality of image-bearing members are provided with their respective fur brushes, when all the fur brushes are operated at the same timing, an electric power required for starting up the fur brushes is significantly large.

SUMMARY OF THE INVENTION

The present disclosure provides an image forming apparatus capable of reducing the intensive use of an electric power in starting up fur brushes.

The present disclosure provides an image forming apparatus including a first image forming portion, a second image forming portion, and a control portion. The first image forming portion includes a first image-bearing member, a toner image forming portion configured to form a first toner image on the first image-bearing member, and a first cleaning member being rotatable and configured to clean the first toner image on the first image-bearing member by rotation. The second image forming portion includes a second image-bearing member, a toner image forming portion configured to form a second toner image on the second image-bearing member, and a second cleaning member being rotatable and configured to clean the second toner image on the second image-bearing member by rotation. The control portion is configured to control a rotation start timing for each of the first and second cleaning members such that when an image forming operation starts after an image forming signal for forming an image on a recording medium is input, an output of a signal for starting the rotation of the first cleaning member and an output of a signal for starting the rotation of the second cleaning member are different.

According to other aspects of the present disclosure, one or more additional image forming apparatuses and one or more methods of using or controlling one or more image forming apparatuses are discussed herein. Further features of the present disclosure will become apparent from the following description of exemplary embodiments with reference to the attached drawings.

DESCRIPTION OF THE EMBODIMENTS

First Embodiment

A first embodiment of the present disclosure is described below with reference to FIGS. 1 to 6. First, a general configuration of an image forming apparatus in the present embodiment is described with reference to FIG. 1.

[Outline of Image Forming Apparatus]

Figure 1:
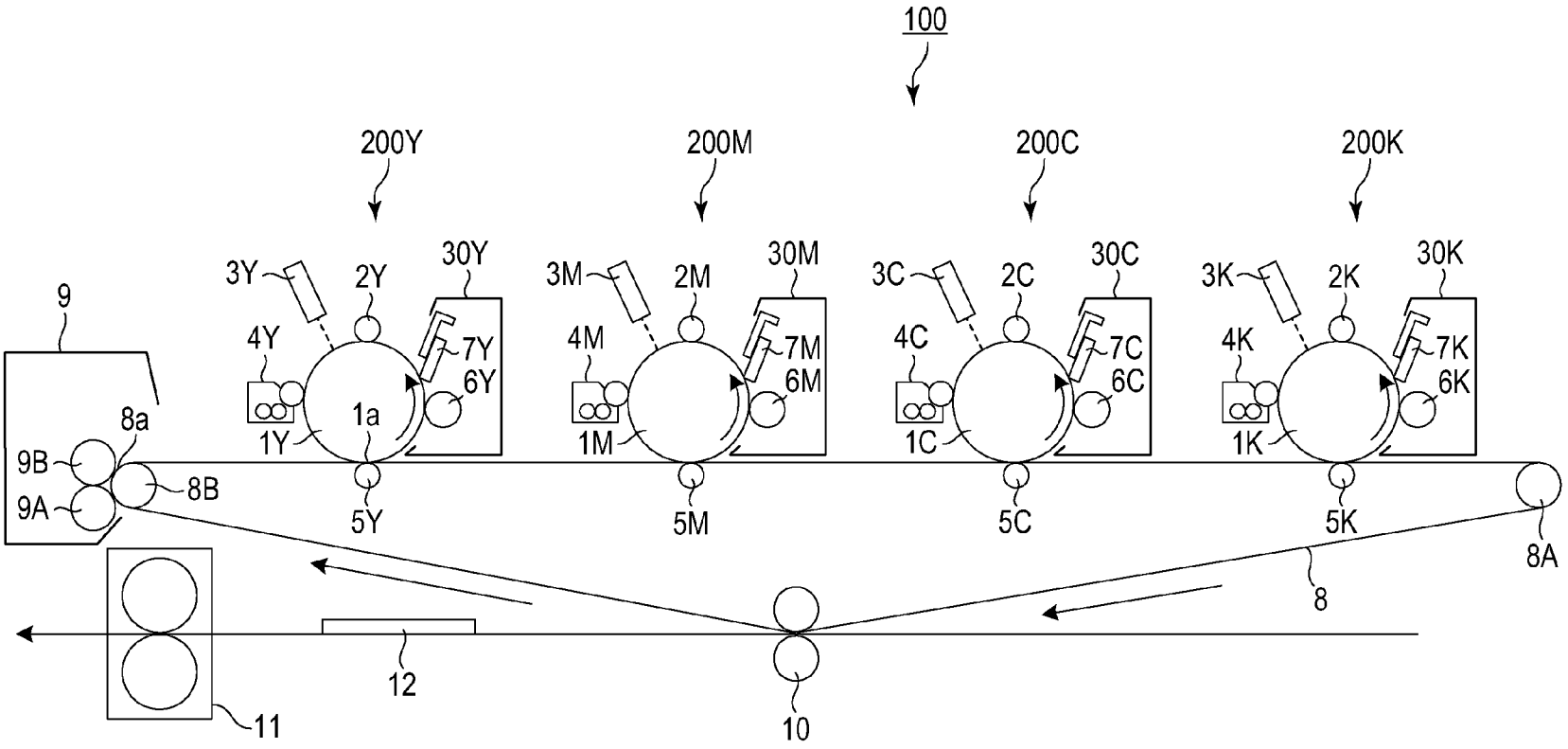
FIG. 1 is a diagram that illustrates an image forming apparatus according to a first embodiment of the present disclosure.

FIG. 1 is a diagram that illustrates an embodiment of the image forming apparatus in the present disclosure. As illustrated in FIG. 1, an image forming apparatus 100 is a full-color image forming apparatus using an electrophotographic technology. In the image forming apparatus 100, image forming units 200Y, 200M, 200C, and 200K configured to form toner images of four colors are arranged. These four image forming units 200Y, 200M, 200C, and 200K have substantially the same configuration. In the following description, the configuration of the image forming unit 200Y for yellow is described as a representative. For the other image forming units, the members having the same configurations and functions as those in the image forming unit 200Y bear the same numerals and corresponding suffixes indicating their respective units. The toner images of four colors are made up of yellow (Y), magenta (M), cyan (C), and black (K) images.

The image forming unit 200Y includes a photosensitive drum 1Y as a rotationally drivable image-bearing member configured to bear a toner image, a charging device 2Y, an exposing device 3Y, a developing device 4Y, a primary transfer roller 5Y, and a cleaning device 30Y. The surface of the photosensitive drum 1Y is charged by the charging device 2Y as charging means. The charged surface of the photosensitive drum 1Y is exposed by the exposing device 3Y as electrostatic latent image forming means based on image information, and an electrostatic latent image is formed thereon. The electrostatic latent image on the photosensitive drum 1Y is developed as a toner image by the developing device 4Y as developing means. The toner image on the photosensitive drum 1Y is primarily transferred by the primary transfer roller 5Y as primary transfer means at a primary transfer portion to an intermediate transfer belt 8 as an intermediate transfer member. Foreign matter remaining on the photosensitive drum 1Y after the transfer, such as toner, is cleaned by the cleaning device 30Y as cleaning means. The cleaning device 30Y includes a fur brush 6Y (cleaning rotator) configured to clean (remove) foreign matter on the photosensitive drum 1Y and a cleaning blade 7Y configured to remove foreign matter with attractive force reduced by the fur brush 6Y.

The toner images of different colors formed by the image forming units 200Y, 200M, 200C, and 200K are transferred to the intermediate transfer belt 8 in an overlapping manner. The toner images transferred to the intermediate transfer belt 8 is made to arrive at a secondary transfer portion opposed a secondary transfer roller 10 by the intermediate transfer belt 8 rotationally driven in a direction indicated by the arrows in FIG. 1. The toner images on the intermediate transfer belt 8 are secondarily transferred to a recording medium 12 (a sheet of paper, a sheet material, such as a transparency, or the like) at the secondary transfer portion and are fixed on the recording medium 12 by a fixing device 11 as fixing means. Toner remaining on the intermediate transfer belt 8 after the secondary transfer (secondary transfer residual toner) is cleaned (removed) from the intermediate transfer belt 8 by an intermediate transfer belt cleaning device 9 as an intermediate transfer member cleaning portion.

Figure 2:
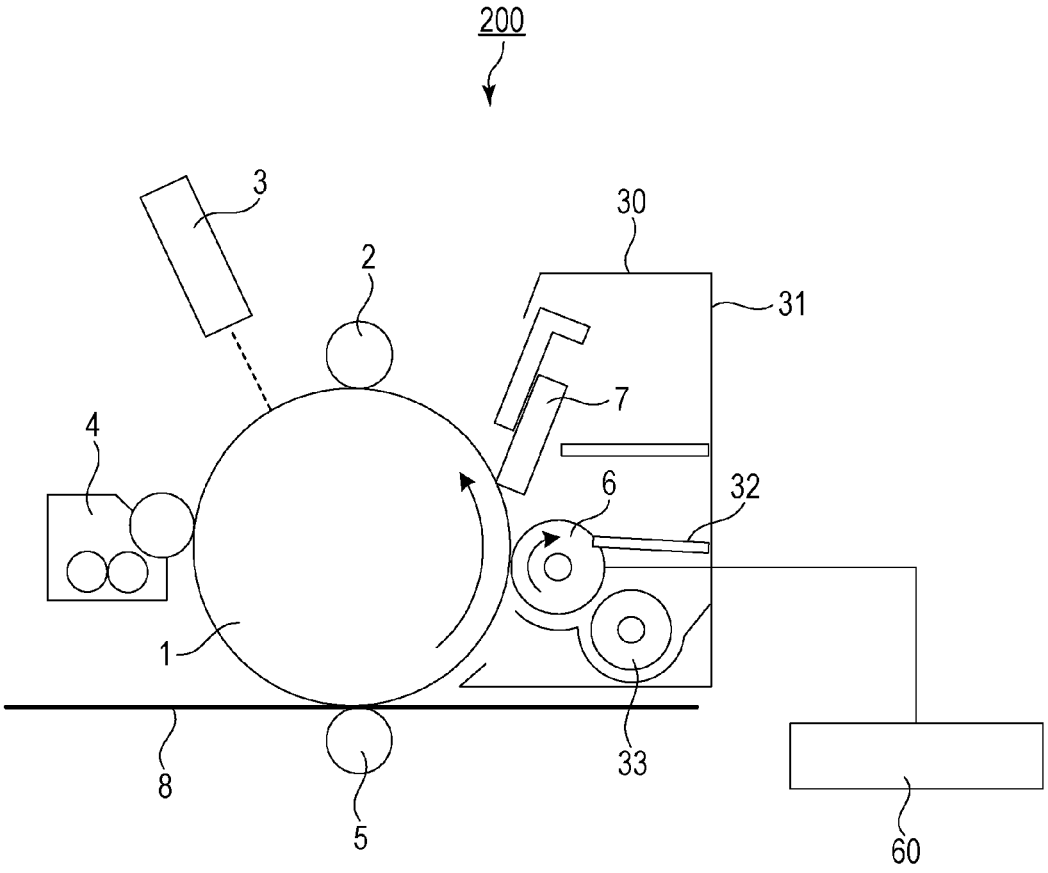
FIG. 2 is a diagram that illustrates an image forming unit according to the first embodiment of the present disclosure.

Next, the elements in the above-described image forming unit 200Y are described with reference to FIG. 2. In the following description, a configuration common to the image forming units is described without suffixes. A configuration specific to an image forming unit is described with a suffix.

[Toner]

In the present embodiment, the image forming apparatus 100 uses toner that is obtained by crushing and classifying a mixture in which a resin binder predominantly composed of polyester is kneaded with a pigment and that has an average particle diameter of approximately 6 μm. The toner is frictionally charged to negative polarity by rubbing with a magnetic carrier. The average charge amount of the toner attached to an electric potential at an exposure portion in the photosensitive drum 1 is approximately −30 μC/g.

[Photosensitive Drum]

The photosensitive drum 1 has a cylindrical shape with an axial length of 360 mm and an outside diameter of 84 mm and has a negatively chargeable organic photoconductor (OPC). Specifically, in the photosensitive drum 1, a photosensitive layer including a photoconductive layer predominantly composed of an organic photoconductor is disposed on an electro-conductive base member. The OPC is typically a lamination in which a charge generation layer, charge transport layer, and surface protecting layer that are made of an organic material are laminated on a metal base member as an electro-conductive base member. In the present embodiment, a material described in Japanese Patent Laid-Open No. 2005-43806 is used in each layer. The photosensitive drum 1 is rotationally driven in a direction indicated by the arrow during image formation by a drum motor 50 (see FIG. 4) as photoconductor driving means at a process speed (peripheral speed) of normally 300 mm/s.

[Charging Device]

The charging device 2 is a contact charging roller and is configured to charge the photosensitive drum 1 by employing an electric discharge phenomenon occurring in a minute gap between the charging device 2 and the photosensitive drum 1. A cored bar in the charging device 2 is subjected to an applied charging bias voltage having preset conditions. For example, in the case where the applied DC bias is set at −500 V and AC bias is set at a peak-to-peak bias higher than or equal to twice a discharge start voltage under that environment, the charging device 2 performs charging processing such that an image forming portion in the photosensitive drum 1 is uniformly charged to approximately −500 V. A charging potential in the charging processing by the charging device 2 is negative (has the negative polarity) and charges the photosensitive drum 1 to the negative side. The DC bias applied during image formation is not limited to −500 V and is set at an electric potential suited for satisfactory image formation in accordance with the environment and circumstances, such as times for which the photosensitive drum 1 and charging device 2 are used, lifespans, and the like, as appropriate. The charging device 2 is not limited to the contact charging roller and may be another configuration, such as a noncontact charging roller or a device that uses corona charging.

[Exposing Device]

The exposing device 3 includes a semiconductor laser configured to perform image exposure on the photosensitive drum 1 with the surface uniformly charged by the charging device 2 based on image information. In the present embodiment, a potential of exposure with laser light is −200 V. The image forming unit 200 is provided with an electric potential measuring device (not illustrated) configured to measure the potential of the photosensitive drum 1 after the exposure and thus can check whether each of the charging potential and the exposure potential is actually a predetermined potential. In the present embodiment, the exposing device 3 is configured to perform image exposure by using the semiconductor laser. The exposing device 3 may be configured to perform image exposure by using another means, such as a light-emitting diode.

[Developing Device]

The developing device 4 includes a development container that stores two-component developer being a mixture of nonmagnetic toner and a magnetic carrier and a rotatable developing sleeve disposed at an opening portion in the development container. The developing sleeve has the functions of magnetically holding the developer in the development container by using a magnet fixed therein and of conveying the developer to a development portion being a gap portion between the developing sleeve and the photosensitive drum 1. The axial length of the developing sleeve is 325 mm. The developing sleeve is connected to a high voltage power source configured to apply a development bias in which a direct-current voltage (−400 V) and an alternating-current voltage (Vp-p is 1600 V) are superimposed. By attaching toner to an electrostatic latent image by the development bias, developing processing is performed. The set value of the development bias is an example and may be set at a value adjusted in accordance with the charging potential or exposure potential for the photosensitive drum 1 as appropriate.

[Cleaning Device]

Next, the cleaning device 30 included in the image forming unit 200 is described in detail with reference to FIG. 2. FIG. 2 is a cross-sectional view that illustrates the details of the cleaning device 30. The cleaning device 30 includes the fur brush 6, which has a brush shape, configured to scrape toner on the photosensitive drum 1 (image bearing member) and scrub the surface of the photosensitive drum 1. The cleaning device 30 includes the cleaning blade 7 located downstream of the fur brush 6 in the rotational direction of the photosensitive drum 1 and configured to clean the surface of the photosensitive drum 1. The cleaning device 30 houses the fur brush 6 and cleaning blade 7 inside a housing 31.

The fur brush 6 has a rotating shaft with fibers implanted therein and, in the present embodiment, is produced by winding cloth with fibers implanted therein around a metal rotating shaft having a diameter of 12 mm. The fibers of the fur brush 6 in the present embodiment are bundles of 6-denier acrylic filaments and are implanted in a base material with a bristle implant density of 50 kF/inch$^2$ per filament. The fibers of the fur brush 6 have a length of 4.5 mm. The fur brush 6 is disposed in the image forming unit 200 such that the leading ends of the fibers enter the photosensitive drum 1 by approximately 0.4 mm.

The fur brush 6 is mounted such that the metal rotating shaft is grounded when it is mounted to the image forming apparatus. The photosensitive drum 1 and fur brush 6 are set such that both are rotated in the same direction at a contact nip portion where both are in contact with each other, as indicated by the arrows illustrated in FIG. 2. The rotation of the fur brush 6 is driven by a cleaning motor 60 as fur brush driving means and can be freely rotated by being controlled by a control portion 40. In the present embodiment, the ratio of a peripheral speed of the fur brush 6 during steady rotation in which acceleration has been completed and the speed is constant to a peripheral speed of the photosensitive drum 1 during steady rotation is 110%. That is, the fur brush 6 and photosensitive drum 1 rotate at peripheral speeds at which the ratio of the peripheral speed of the fur brush 6 to that of the photosensitive drum 1 during steady rotation is 1.1. The peripheral speed at which the photosensitive drum 1 is in steady rotation is a speed at which images can be formed in the image forming apparatus 100.

The fibers in the fur brush 6 are described in detail below. Each of the fibers in the fur brush 6 has a substantially circular cross-sectional shape and a surface shape having fine ridges and holes in places. The fine ridges provide the fur brush 6 with an increased area of a contact surface with foreign matter on the photosensitive drum 1, and this leads to improved collecting performance. The cross-sectional shape of each of the fibers in the fur brush 6 is not limited to being circular and may be other shapes, such as oval, polygonal, or star shapes. It is useful that the cross-sectional shape of each of the fibers in the fur brush 6 may be selected in consideration of, in addition to the performance of colleting foreign matter, potential changes caused by contact with the surface layer of the photosensitive drum 1, effects of rubbing on the surface layer of the photosensitive drum 1, or other factors.

The fibers in the fur brush 6 in the cleaning device 30 are made of acrylic, which has characteristics of tending to become negative in the triboelectric series. The cleaning device 30 uses fibers that adjust resistance of the fibers by, for example, having a certain amount of carbon distributed in the fibers in the fur brush 6 and that possess electrical conductivity. The material that tends to be negatively charged is used in the fur brush 6 because an average charge amount in toner remaining on the photosensitive drum 1 in the image forming unit 200 can be of positive polarity (on the positive side). The state where the average charge amount in toner is on the positive side arises from the effects occurring when it passes through the primary transfer roller 5 and results from being able to switch from negative to positive in polarity caused by a significant decrease in the average charge amount in untransferred toner.

Thus, the use of the material that tends to become negative in the triboelectric series in the fibers in the fur brush 6 enables the cleaning device 30 to easily collet toner or the like that is made positive by the fur brush 6. The use of the material that tends to become negative in the triboelectric series in the fibers in the fur brush 6 enables the cleaning device 30 to easily remove foreign matter from the surface of the photosensitive drum 1 and to assist the cleaning blade 7 in cleaning. The cleaning device 30 can perform discharging in which a negatively charged potential in the photosensitive drum 1 by causing the fur brush 6 to be in contact with the photosensitive drum 1 returns toward zero. The fibers in the fur brush 6 are not limited to acrylic and may be another material such as polyester, nylon, Teflon (registered trademark), or vinyl chloride. As the fibers in the fur brush 6, a material that tends to become charged to polarity opposite to that of the charging potential of the toner and photosensitive drum 1 in the triboelectric series may be used in order to facilitate collecting negative toner or the like.

The cleaning blade 7 is made of urethane rubber and has an elastic force. The cleaning blade 7 in the present embodiment has an axial length of 340 mm and is in contact with the photosensitive drum 1 with a predetermined abutment pressure.

Next, the details of the removal of foreign matter on the photosensitive drum 1 by the cleaning device 30 are described. The cleaning device 30 weakens an attractive force to the photosensitive drum 1 by disturbing residues (foreign matter), such as toner (transfer residual toner), on the surface of the photosensitive drum 1 after a toner image is transferred by using the fur brush 6. After weakening the attractive force of the foreign matter on the photosensitive drum 1 by using the fur brush 6, the cleaning device 30 removes the foreign matter from the surface of the photosensitive drum 1 by using the cleaning blade 7. The foreign matter removed from the surface of the photosensitive drum 1 is temporarily held on the fur brush 6 and then is transported to a scraper 32 being in contact with a circumferential surface of the fur brush 6 by rotation of the fur brush 6. The foreign matter flies out of the fur brush 6 by a repulsive force of the fibers in the fur brush 6 elastically deformed by being in contact with the scraper 32 and falls on a conveying screw 33 or its vicinity. The foreign matter falling on the conveying screw 33 or its vicinity is conveyed in an axial direction of the photosensitive drum 1 by the conveying screw 33, which extends along the rotational axial direction of the photosensitive drum 1, passes through a collecting toner conveyance passage (not illustrated), and is collected by a toner collecting container (not illustrated).

The foreign matter removed by the fur brush 6 and cleaning blade 7 includes substances other than the transfer residual toner on the photosensitive drum 1. The photosensitive drum 1 undesirably collects other substances, such as secondary transfer residual toner on the intermediate transfer belt 8 (on the intermediate transfer member), paper dust and filler containing paper fibers included in the recording medium 12, calcium carbonate, or the like. Thus, the cleaning device 30 also cleans the secondary transfer residual toner and foreign matter such as components stemming from the recording medium 12, together with the transfer residual toner on the photosensitive drum 1. The secondary transfer residual toner and components stemming from the recording medium 12 on the intermediate transfer belt 8 should be cleaned by the intermediate transfer belt cleaning device 9, but it is difficult to fully clean them. Foreign matter that has not been cleaned arrives at the photosensitive drum 1.

When the components stemming from the recording medium 12 on the intermediate transfer belt 8 arrive at the cleaning blade 7 in the cleaning device 30, they are caught in a contact portion between the cleaning blade 7 and the photosensitive drum 1, and cleaning defects are likely to occur. Thus, it is useful to remove the components stemming from the recording medium 12 by using the fur brush 6 before they arrives at the cleaning blade 7. When the intermediate transfer belt 8 is rotationally driven, the components stemming from the recording medium 12 may be conveyed to the photosensitive drum 1 from the intermediate transfer belt cleaning device 9, and thus it is useful to drive the fur brush 6 in the cleaning device 30.

[Frictional Charging by Fur Brush]

Next, frictional charging the photosensitive drum 1 by the fur brush 6 is described. As previously described, in the present embodiment, the fur brush 6 is made of an acrylic fiber, and the photosensitive drum 1 is made of an OPC. Accordingly, the fur brush 6 is on the negative side in the triboelectric series with respect to the photosensitive drum 1. Thus, if the photosensitive drum 1 comes into contact with the fur brush 6 too many times, the photosensitive drum 1 is charged to polarity opposite to that of the charging potential.

Figure 3:
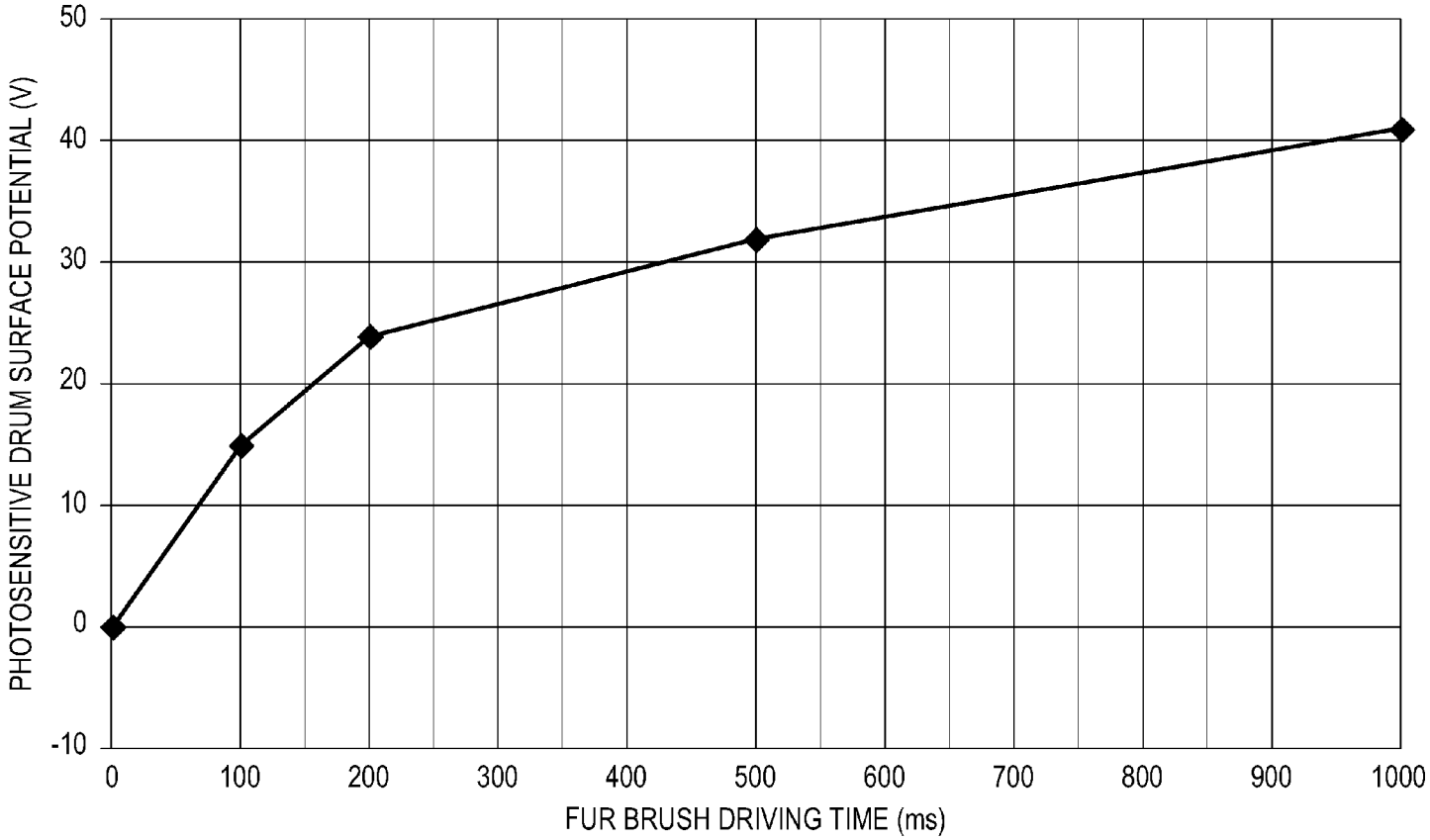
FIG. 3 is a graph that illustrates a relationship between a surface potential of a photosensitive drum and a time for which a fur brush is driven according to the first embodiment of the present disclosure.

FIG. 3 is a graph that illustrates a relationship between the time for which the fur brush 6 is driven (rubs) and the surface potential of the photosensitive drum 1 when the fur brush 6 is driven in a state where the photosensitive drum 1 is at rest. FIG. 3 reveals that although the surface potential of the photosensitive drum 1 is substantially zero at a point in time before the fur brush 6 is driven, as the fur brush 6 is driven, the photosensitive drum 1 is charged to the positive side, which is opposite to the polarity of the charging potential. If the photosensitive drum 1 is charged at the positive side, it is difficult for the photosensitive drum 1 to be uniformly charged by the charging device 2, and a potential difference locally arises on its surface. In this case, when image exposure light is emitted from the exposing device 3, an electrostatic latent image with a different charging potential is formed locally, and when a development bias is applied by the developing device 4, the amount of toner increases locally, and unevenness of image is likely to occur. Thus, it is useful that in a state where the photosensitive drum 1 is at rest, the fur brush 6 is not driven. In the following description, the state in which the photosensitive drum 1 is charged to polarity (positive) opposite to that of the charging potential (negative) is also described as being positively charged. The state in which the photosensitive drum 1 is charged to the same polarity as that of the charging potential (negative) is also described as being negatively charged.

When the fur brush 6 is new and near to its initial state, no contamination by transfer residual toner occurs, and the stiffness of the fibers is high and cleaning performance is high. Accordingly, the newer the fur brush 6 is, the more likely the photosensitive drum 1 is to be positively charged by the driving of the fur brush 6.

In contrast, the more clogged the inside of the fur brush 6 is with toner, the less the effects on the charging potential of the photosensitive drum 1 by the driving of the fur brush 6 are. The effects on the charging potential of the photosensitive drum 1 by the driving of the fur brush 6 degraded by repeated use are also small. These phenomena are estimated to result from a change in the cleaning performance arising from a change in the driving torque of the fur brush 6 caused by a condition where toner is attached to the fur brush 6 or a change over time, such as an occurrence of a bend or twist in the fibers or shrinkage of an outer diameter of the fur brush 6.

[Intermediate Transfer Belt]

The intermediate transfer belt 8 is an endless belt, is rotationally driven in the direction indicated by the arrows in FIG. 1 by a driving roller 8A, and has a three-tier structure in which a resin layer, an elastic layer, and a surface layer are positioned in this order from the back side. In the present embodiment, examples of a resin material that forms the resin layer in the intermediate transfer belt 8 may include polyimide and polycarbonate. The resin layer has a thickness of 70 μm to 100 μm. Examples of an elastic material that forms the elastic layer in the intermediate transfer belt 8 may include urethane rubber and chloroprene rubber. The elastic layer has a thickness of 200 μm to 250 μm.

It is useful that the surface layer in the intermediate transfer belt 8 is made of a material that can reduce the attractive force of toner to the surface of the intermediate transfer belt 8 and that facilitates transferring a toner image to the recording medium 12 at the secondary transfer roller 10. In the present embodiment, the surface layer in the intermediate transfer belt 8 may be made of a resin material of any one of polyurethane, polyester, epoxy resin, and other resins or elastic materials of any two or more of elastic rubber, elastomer, butyl rubber, and other elastic materials. The intermediate transfer belt 8 may use one kind or two or more kinds of powder and grains, including fluorocarbon polymers, as a material for reducing a surface energy and increasing lubricity and distribute it in the material forming the surface layer. In the case where the intermediate transfer belt 8 uses powder and grains of fluorocarbon polymers or the like, the powder and grains may have nonuniform particle and grain sizes.

The surface layer in the intermediate transfer belt 8 in the present embodiment has a thickness of 5 μm to 10 μm. The surface layer in the intermediate transfer belt 8 includes an additive conductive material for adjusting a resistance value, such as carbon black, and its volume resistivity is $1e^{8}$ Ωcm to $1e^{14}$ Ωcm. [Intermediate Transfer Belt Cleaning Device]

The intermediate transfer belt cleaning device 9 is disposed at a location opposed to a tension roller 8B for stretching the intermediate transfer belt 8 and includes two fur brushes whose material and shape are the same as those of the fur brush 6, and the two fur brushes are disposed along the rotational drive direction of the intermediate transfer belt 8. Of the two fur brushes included in the intermediate transfer belt cleaning device 9, an upstream fur brush 9A is arranged on the upstream side in the rotational drive direction of the intermediate transfer belt 8 and applies a negative bias to secondary transfer residual toner on the intermediate transfer belt 8. Of the two fur brushes included in the intermediate transfer belt cleaning device 9, a downstream fur brush 9B is arranged on the downstream side in the rotational drive direction of the intermediate transfer belt 8 with respect to the upstream fur brush 9A and applies a positive bias to the secondary transfer residual toner on the intermediate transfer belt 8. The upstream fur brush 9A and downstream fur brush 9B are disposed such that the leading ends of the fibers enter the intermediate transfer belt 8 by approximately 0.8 mm.

In the present embodiment, a voltage that enables an electric current of −50 μA to flow is applied to the upstream fur brush 9A to collect the secondary transfer residual toner on the intermediate transfer belt 8 and cause the secondary transfer residual toner to be negatively charged. A voltage that enables an electric current of +55 μA to flow is applied to the downstream fur brush 9B to collect the secondary transfer residual toner made negative by the upstream fur brush 9A.

The intermediate transfer belt cleaning device 9 cleans the secondary transfer residual toner and the components stemming from the recording medium 12 on the intermediate transfer belt 8 by using the upstream fur brush 9A and downstream fur brush 9B. The intermediate transfer belt cleaning device 9 collects components such as toner attached to the upstream fur brush 9A and downstream fur brush 9B by using a scraper (not illustrated), as in the case of the cleaning device 30. The scraper may not be used, and the intermediate transfer belt cleaning device 9 may include a metallic roller being in contact with each of the upstream fur brush 9A and downstream fur brush 9B. In this configuration, the intermediate transfer belt cleaning device 9 collects foreign matter on the upstream fur brush 9A and downstream fur brush 9B by employing a potential difference between the metallic roller and each of the upstream fur brush 9A and downstream fur brush 9B.

The image forming apparatus 100 can collect most of the foreign matter on the intermediate transfer belt 8 by using the intermediate transfer belt cleaning device 9. Unfortunately, however, the intermediate transfer belt cleaning device 9 may be unable to fully collect the foreign matter, and some may remain on the intermediate transfer belt 8. In the intermediate transfer belt cleaning device 9, the scraper may be unable to fully remove the foreign matter on the upstream fur brush 9A and downstream fur brush 9B. In such a case, the intermediate transfer belt cleaning device 9 may eject the foreign matter attached to the upstream fur brush 9A and downstream fur brush 9B to the intermediate transfer belt 8 when the upstream fur brush 9A and downstream fur brush 9B are driven. The foreign matter ejected to the intermediate transfer belt 8 may be conveyed to the image forming unit 200. As previously described, if the foreign matter is conveyed to the image forming unit 200, the cleaning performance by the cleaning blade 7 may degrade, and this may lead to the occurrence of cleaning defects.

[Control Portion]

Figure 4:
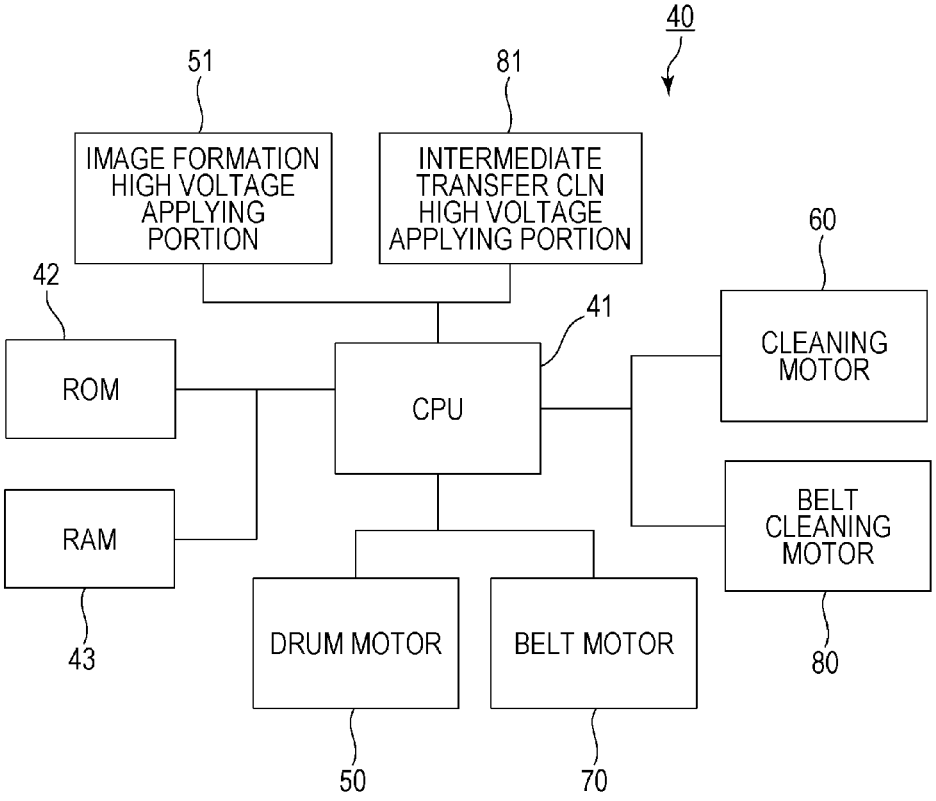
FIG. 4 is a block diagram that illustrates a configuration of a control portion in the image forming apparatus according to the first embodiment of the present disclosure.

FIG. 4 is a block diagram that illustrates a configuration of the control portion 40 for controlling the image forming apparatus 100. As illustrated in FIG. 4, the control portion 40 includes a CPU 41, which is a central processing unit for performing various control, a read-only memory (ROM) 42 configured to store programs executable by the CPU 41 and various data, and a random-access memory (RAM) 43 configured to temporarily retain results of computation by the CPU 41 and other data.

The CPU 41 controls a drum motor 50 configured to rotationally drive the photosensitive drum 1 and the cleaning motor 60 configured to rotationally drive the fur brush in each of the image forming units. The CPU 41 also controls a belt motor 70 as intermediate transfer belt driving means configured to rotationally drive the driving roller 8A, which is configured to rotationally drive the intermediate transfer belt 8. The CPU 41 also controls a belt cleaning motor 80 as intermediate transfer CLN driving means configured to rotationally drive the upstream fur brush 9A and downstream fur brush 9B included in the intermediate transfer belt cleaning device 9. The CPU 41 emits driving OFF/ON signals to the motors in accordance with an executing program.

The CPU 41 controls an image formation high voltage applying portion 51 configured to control a charging voltage applied to the charging devices, a developing voltage applied to the exposing devices, and a transferring voltage applied to the primary transfer rollers. The CPU 41 also controls an intermediate transfer CLN high voltage applying portion 81 configured to apply a high-voltage potential to the intermediate transfer belt cleaning device 9. The CPU 41 emits high-voltage OFF/ON signals to the high voltage applying portions.

[Fur Brush Control]

In the image forming apparatus 100 in the present embodiment, the image forming unit 200Y is nearest the intermediate transfer belt cleaning device 9 in the rotational drive direction of the intermediate transfer belt 8. The distance from the intermediate transfer belt cleaning device 9 to the fur brush 6Y in the image forming unit 200Y along the intermediate transfer belt 8 and photosensitive drum 1Y is 90 mm. That is, the sum of the distance traveled by a cleaned portion 8*a*, which is in contact with the intermediate transfer belt cleaning device 9 at the initiation of driving of the intermediate transfer belt 8, to when it arrives at the photosensitive drum 1Y and the distance traveled by a surface 1*a*, which is opposed to the cleaned portion 8*a*, of the photosensitive drum 1Y to when it arrives at the fur brush 6Y is 90 mm. Because the process speed of the image forming apparatus 100 in the present embodiment is 300 mm/sec, the foreign matter from the intermediate transfer belt cleaning device 9 arrives at the fur brush 6Y in 300 ms.

Each of the drum motor 50 and belt motor 70 in the present embodiment is a stepping motor and can make the photosensitive drum 1 and intermediate transfer belt 8 reach a steady rotation where both are stably driven in 200 ms from the initiation of the driving. The image forming apparatus 100 can also make the photosensitive drum 1 and intermediate transfer belt 8 reach the steady rotation in less than 200 ms. It is useful that both reach the steady rotation in not less than 100 ms to avoid a large peripheral speed difference between the photosensitive drum 1 and intermediate transfer belt 8.

The cleaning motor 60 in the present embodiment is a DC motor. Thus, the time it takes the fur brush 6 to reach a steady rotation since a driving ON signal is transmitted from the CPU 41 to the cleaning motor 60 varies depending on the state of the fur brush 6 or product variation of DC motors used in the cleaning motor 60. The time required to reach the steady rotation varies depending on the state of the fur brush 6 because the state where the fur brush 6 is in contact with the photosensitive drum 1 varies and the driving torque of the fur brush 6 varies depending on the state of the fur brush 6.

Therefore, the CPU 41 sets the timing when it drives the fur brush 6 on the assumption that the cleaning motor 60 is a DC motor in which the driving torque of the fur brush 6 is high and the startup characteristics are not good. It is found that the time it takes the cleaning motor 60 in the present embodiment to reach a steady rotation from the initiation of rotation is 100 ms at maximum.

Traditional image forming apparatuses typically start driving a fur brush and a photosensitive drum at the same time. However, if a driving shock occurs when an attempt to drive both at the same time is made, the fur brush may start rotating before the photosensitive drum starts being driven, the photosensitive drum may be much rubbed with the fur brush locally, an area charged to polarity opposite the charging potential ("memory") may appear in the photosensitive drum. If the charging in the memory is slight, the image forming apparatus can recover the memory by idly rotating the photosensitive drum. If the photosensitive drum is idly rotated for a period of time required to recover the memory, the time for the idle rotation (down time) is taken before image formation starts, and this impairs usability.

To address this issue, in the present embodiment, the drum motor 50 and cleaning motor 60 are independent from each other, and both are independently controlled by the CPU 41. The CPU 41 prevents the appearance of memory by controlling the drum motor 50 and cleaning motor 60 so as not to drive both at the same time. The details of the control of the drum motor 50 and cleaning motor 60 by the CPU 41 are described below.

Figure 5:
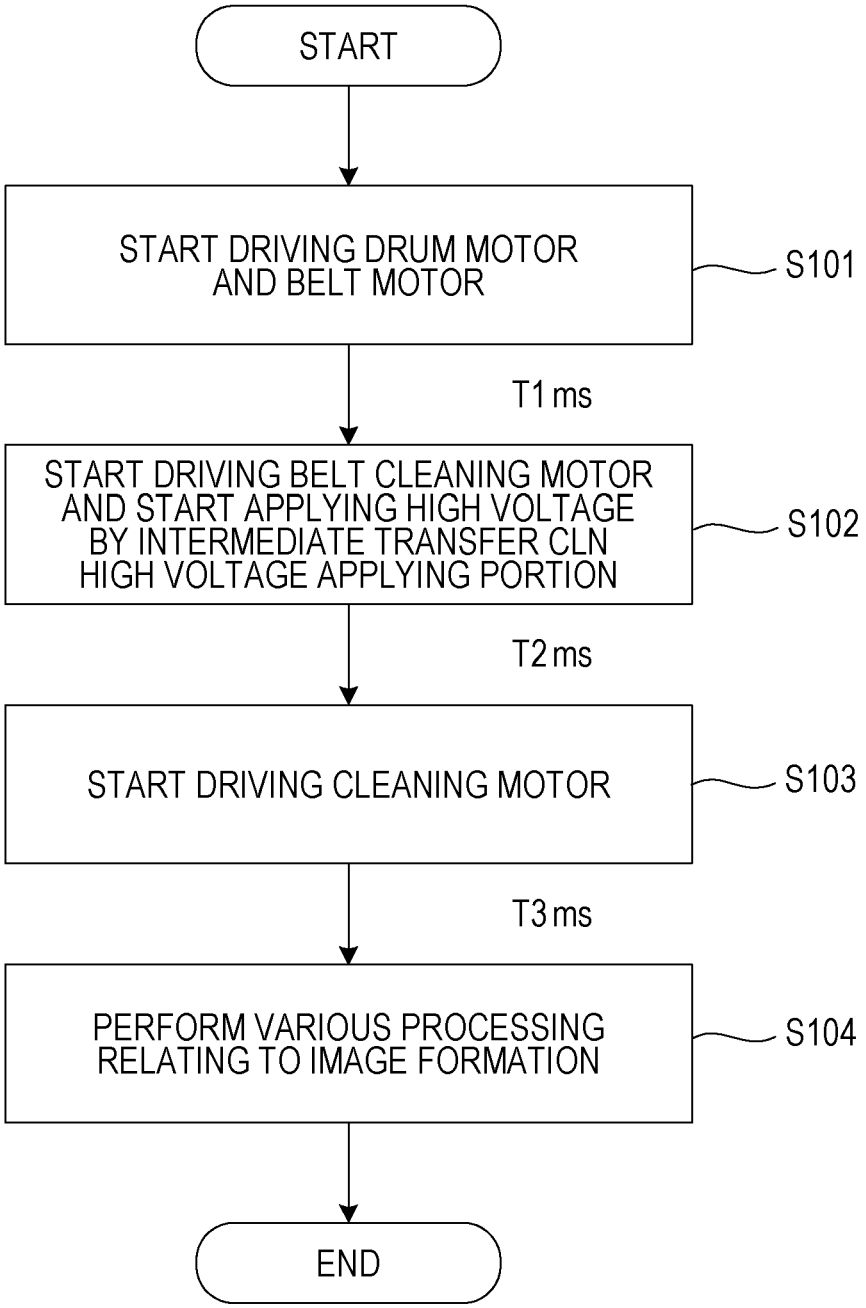
FIG. 5 is a flow chart that illustrates control processing performed by the control portion according to the first embodiment of the present disclosure.
Figure 6:
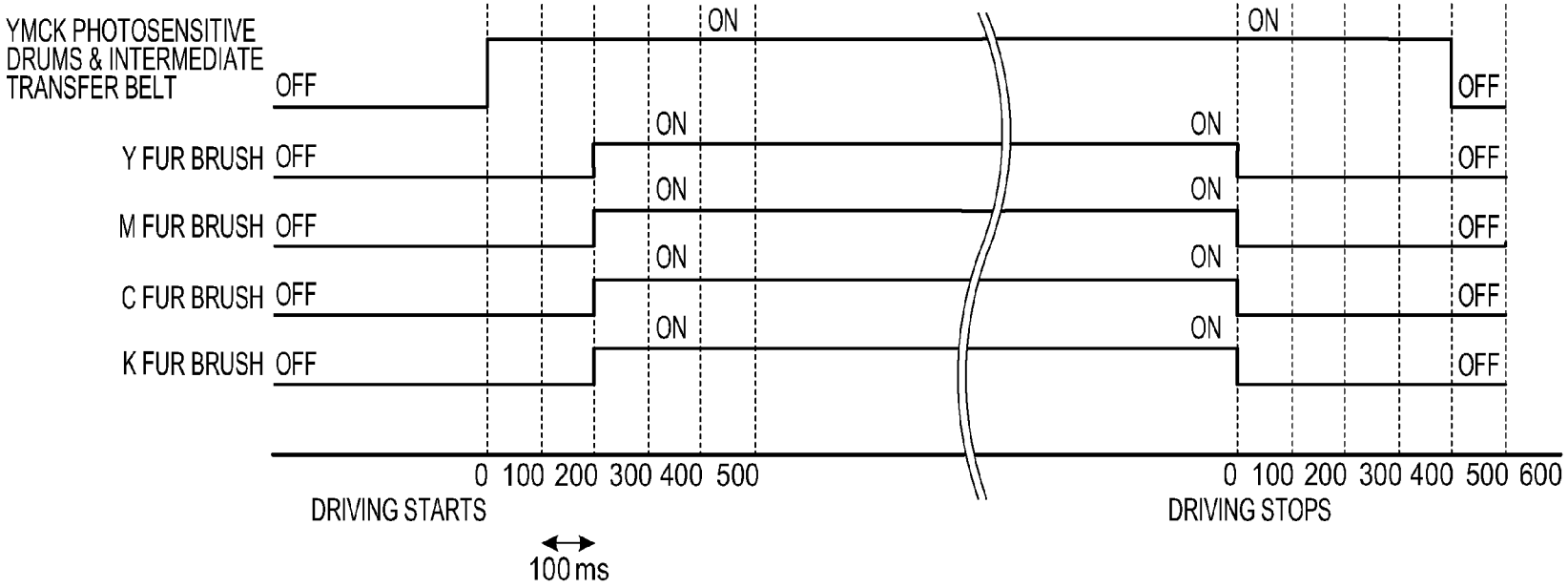
FIG. 6 is a sequence chart that illustrates the control processing performed by the control portion according to the first embodiment of the present disclosure.

FIG. 5 is a flow chart that illustrates control processing when the CPU 41 performs drive control for the photosensitive drum 1 and fur brush 6. FIG. 6 is a sequence chart that illustrates behaviors of the drum motor 50, cleaning motor 60, and belt motor 70 when the CPU 41 performs the control in accordance with the flow chart illustrated in FIG. 5. The sequence chart in FIG. 6 schematically illustrates timings when signals for turning-on electrical driving are input into the motors. Thus, real operations of each of the motors may differ by the order of several tens of microseconds depending on the status of the torque of an object to be driven. It is necessary for the image forming apparatus 100 to determine the timing when the driving of each of the motors starts while checking the real operations for driving the motors.

As illustrated in FIG. 5, the CPU 41 first starts driving the drum motor 50 and belt motor 70 (S101). In the processing at step S101, the CPU 41 outputs a driving ON signal to each of the drum motor 50 and belt motor 70 to start driving the drum motor 50 and belt motor 70 at the same time. In the image forming apparatus 100, as illustrated in FIG. 6, the driving ON signal is output to each of the drum motor 50 and belt motor 70, so that rotation of the photosensitive drum 1 and rotational drive of the intermediate transfer belt 8 start at the same time. The timing when the driving ON signal is output to each of the drum motor 50 and belt motor 70 and the rotation of the photosensitive drum 1 and rotational drive of the intermediate transfer belt 8 start at the same time is defined as first start timing A1. In the following description, the first start timing A1 is used as the reference (0 ms) in the staring operation.

As previously described, the photosensitive drum 1 and intermediate transfer belt 8 are configured such that both reach a steady rotation in 200 ms since both start rotating. Thus, it is desirable that the fur brush 6Y in the present embodiment start rotating after the time it takes the photosensitive drum 1 to start the steady rotation from the first start timing A1 (=200 ms) or more elapses.

In the image forming apparatus 100, as described above, foreign matter from the intermediate transfer belt cleaning device 9 arrives at the fur brush 6Y in 300 ms. Thus, it is useful that the image forming apparatus 100 performs control such that the fur brush 6Y can reach a steady rotation before 300 ms elapses from the initiation of rotational drive of the intermediate transfer belt 8. As previously described, the fur brush 6 is configured such that it reaches the steady rotation in 100 ms from the initiation of rotation.

In consideration of the above, the CPU 41 determines the timing when it outputs the driving ON signal to the cleaning motor 60. The CPU 41 proceeds to processing at step S102 after the elapse of first time T1 (=100 ms) from the processing at step S101. In the processing at step S102, the CPU 41 starts driving the belt cleaning motor 80 and starts applying a high voltage to the upstream fur brush 9A and downstream fur brush 9B by using the intermediate transfer CLN high voltage applying portion 81. Then, the CPU 41 proceeds to processing at step S103 after the elapse of second time T2 (=100 ms) from the processing at step S102. In the processing at step S103, the CPU 41 starts rotation of the fur brush 6 by outputting a driving ON signal to the cleaning motor 60.

In performing the processing at step S103, the CPU 41 outputs the driving ON signal to the cleaning motor 60 and starts rotation of all of the fur brushes 6 of the fur brushes 6Y, 6M, 6C, and 6K at the same time, as illustrated in FIG. 6. The timing when the driving ON signal is output to the cleaning motor 60 and all the fur brushes 6 start rotating is defined as second start timing A2.

In this way, after the elapse of the first time T1 and second time T2 from the processing at step S101, the CPU 41 performs the processing at step S103. Therefore, the CPU 41 can place a time interval equal to or longer than the time required to start a steady rotation of the photosensitive drum 1 (=200 ms) between the initiation of rotation of the photosensitive drum 1 and the initiation of rotation of the fur brush 6. The CPU 41 starts rotation of the fur brush 6Y at the point in time when 200 ms elapses from the initiation of rotational drive of the intermediate transfer belt 8. Accordingly, the CPU 41 can make the fur brush 6Y reach a steady rotation before the elapse of the time it takes foreign matter on the intermediate transfer belt 8 to arrive at the fur brush 6Y from the initiation of rotational drive of the intermediate transfer belt 8 (=300 ms). The CPU 41 can rotate the fur brush 6 and photosensitive drum 1 at peripheral speeds at which the ratio of the peripheral speed of the fur brush 6 to that of the photosensitive drum 1 is always 1.1 or less by starting rotation of the fur brush 6 after the photosensitive drum 1 reaches the steady rotation. The first time T1 and second time T2 constitute a start waiting time in the present embodiment.

By executing the control at steps S101 to S103, the CPU 41 prevents the photosensitive drum 1 and fur brush 6 from starting rotating at the same time. Thus, the image forming apparatus 100 can prevent the photosensitive drum 1 from being robbed with the fur brush 6 locally when each of the photosensitive drum 1 and fur brush 6 starts rotating and can reduce the appearance of memory on the photosensitive drum 1.

After the processing at step S103, the CPU 41 ends the processing relating to the driving of the photosensitive drum 1 and fur brush 6. After the elapse of third time T3, the CPU 41 performs various processing relating to image formation (S104). It is useful that the third time T3 is a time required to stabilize the driving of the photosensitive drum 1, fur brush 6, and intermediate transfer belt 8.

Next, control processing performed by the CPU 41 when it stops the photosensitive drum 1 and fur brush 6 is described with reference to the sequence chart in FIG. 6. As previously described, the cleaning motor 60 in the present embodiment is a DC motor and stops after it rotates by only the amount corresponding to moment of inertia during driving after it is electrically turned off. The cleaning motor 60 is configured such that 300 ms is needed as first stop time S1 taken to stop in the state where the driving torque of the fur brush 6 is low and the moment of inertia of the DC motor is the largest.

As described above, the drum motor 50 is a stepping motor, and it stops after it rotates by only the amount corresponding to moment of inertia of the stepping motor after it is electrically turned off. The drum motor 50 in the present embodiment is configured such that 200 ms is needed as second stop time S2 taken to stop the photosensitive drum 1.

In consideration of the above, the CPU 41 determines the timing when it outputs the driving OFF signal to each of the drum motor 50 and cleaning motor 60. For example, to end an image forming operation and stop, the CPU 41 first outputs the driving OFF signal to the cleaning motor 60. As illustrated in FIG. 6, the CPU 41 outputs the driving OFF signal to the cleaning motor 60 and stops rotation of all of the fur brushes 6Y, 6M, 6C, and 6K at the same time. The timing when the driving OFF signal is output to the cleaning motor 60 and a stopping operation for all the fur brushes 6 starts is defined as first stop timing A3. In the following description, the first stop timing A3 is used as the reference (0 ms) in the stopping operation.

Next, because the first stop time S1 (=300 ms) is needed to stop the fur brush 6 at maximum, the CPU 41 outputs the driving OFF signal to the drum motor 50 and belt motor 70 after the elapse of 300 ms or more from the first stop timing A3. In the present embodiment, the CPU 41 outputs the driving OFF signal to the drum motor 50 and belt motor 70 at the point in time when 400 ms elapses from the first stop timing A3. The timing when the driving OFF signal is output to the drum motor 50 and belt motor 70 and the stopping operation for the photosensitive drum 1 and intermediate transfer belt 8 starts is defined as second stop timing A4.

The CPU 41 can prevent a state where the fur brush 6 is rotating while the photosensitive drum 1 is at rest by starting the stopping operation for the photosensitive drum 1 at the second stop timing A4. Thus, the image forming apparatus 100 can prevent the photosensitive drum 1 from being rubbed with the fur brush 6 locally when the photosensitive drum 1 and fur brush 6 are at rest and can reduce the appearance of memory on the photosensitive drum 1. In this way, the first stop time S1 required to elapse from the first stop timing A3 to the second stop timing A4 constitutes a stop waiting time in the present embodiment.

As described above, the image forming apparatus 100 in the present embodiment starts rotation of the fur brush 6 after starting rotation of the photosensitive drum 1. Thus, the image forming apparatus 100 can reduce the appearance of memory on the photosensitive drum 1 that would be caused by the fur brush 6 when the photosensitive drum 1 and fur brush 6 start rotating at the same time. That is, the image forming apparatus 100 can reduce the phenomenon in which the photosensitive drum 1 is charged by the fur brush 6 to polarity opposite the charging potential by the charging device 2.

In the present embodiment, the CPU 41 is configured such that it outputs the driving ON signal to the cleaning motor 60 after the photosensitive drum 1 and intermediate transfer belt 8 reach a steady rotation. Other forms may also be used. If the fur brush 6 is driven for 100 ms or more in the state where the photosensitive drum 1 is at rest, the portion of the photosensitive drum 1 being in contact with the fur brush 6 is positively charged locally. If the peripheral speed difference between the peripheral speed of the fur brush 6 and that of photosensitive drum 1 is equal to or larger than a certain value, the photosensitive drum 1 is also positively charged.

The case where the photosensitive drum 1 is positively charged by being rubbed with the fur brush 6 rotating at a peripheral speed higher than that of the photosensitive drum 1 is described in detail below. An experiment on the relationship between the peripheral speed of the fur brush 6 with respect to that of the photosensitive drum 1 and the surface potential of the photosensitive drum 1 shows that the surface potential of the photosensitive drum 1 is positively charged to +15 V or more when the fur brush 6 rotates at a peripheral speed of 500% with respect to that of the photosensitive drum 1. In the case where the fur brush 6 rotates at a peripheral speed of 450% with respect to that of the photosensitive drum 1, the surface potential is positively charged to the order of +8 V. In contrast, in the case where the fur brush 6 rotates at a peripheral speed of 400% with respect to that of the photosensitive drum 1, the surface potential of the photosensitive drum 1 is a potential of the order of −10 V to 0 V, and it is not substantially positively charged.

That is, during rotation of the fur brush 6, including under acceleration and deceleration, when the peripheral speed of the fur brush 6 is always lower than 400% with respect to the peripheral speed of the photosensitive drum 1, the image forming apparatus 100 can prevent the photosensitive drum 1 from being positively charged. Accordingly, the CPU 41 can start rotation of the fur brush 6 even before 200 ms elapses since rotation of the photosensitive drum 1 starts, at a timing at which the value of the ratio of the peripheral speed of the fur brush 6 to that of the photosensitive drum 1 is always less than 4.0. Specifically, the CPU 41 may be configured so as to perform the processing at step S103 after the elapse of 150 ms since it performs the processing at step S101 illustrated in FIG. 5. In this configuration, because the value of the ratio of the peripheral speed of the fur brush 6 to that of the photosensitive drum 1 is 2.5 at maximum, the fur brush 6 can be rotated within the range not larger than 4.0, which is the value of the peripheral-speed ratio where the surface potential of the photosensitive drum 1 is not positively charged. In this case, fourth time elapsed since the processing at step S101 is performed (150 ms) constitutes the start waiting time. The value 4.0 of the ratio of the peripheral speed of the fur brush 6 to that of the photosensitive drum 1 constitutes a predetermined value.

With this configuration, the image forming apparatus 100 can properly rub the surface of the photosensitive drum 1 by using the fur brush 6, can enhance the cleaning performance for the photosensitive drum 1, and can prevent the cleaning blade 7 from being damaged by components stemming from the recording medium 12. Because the image forming apparatus 100 can start rotation of the fur brush 6 before the photosensitive drum 1 reaches a steady rotation, the rise time required to start image formation can be reduced, and usability and productivity can be improved.

In rotation stopping operation, the image forming apparatus 100 may start a stopping operation for the photosensitive drum 1 before the fur brush 6 stops, at a timing at which the peripheral speed of the fur brush 6 is always lower than 400% with respect to that of the photosensitive drum 1. With this configuration, the image forming apparatus 100 can reduce the fall time taken to complete image formation and can improve usability. In this case, fifth time elapsed from the initiation of the stopping operation for the fur brush 6 to the initiation of the stopping operation for the photosensitive drum 1 constitutes the stop waiting time.

Another control is described next with reference to FIGS. 7 and 8. In the above configuration, the fur brushes 6Y, 6M, 6C, and 6K start rotating at the same time and start their stopping operations at the same time. However, in the image forming apparatus 100, components stemming from the recording medium 12 seldom reach the image forming units 200C and 200K, which are positioned on the downstream side in the rotational drive direction of the intermediate transfer belt 8.

Specifically, of the total of foreign matter ejected from the intermediate transfer belt cleaning device 9 to the intermediate transfer belt 8, approximately 60% attaches to the photosensitive drum 1Y, and approximately 30% attaches to the photosensitive drum 1M. That is, of the total of the foreign matter on the intermediate transfer belt 8, approximately 90% attaches to the photosensitive drums 1Y and 1M, which are positioned on the upstream side in the rotation direction of the intermediate transfer belt 8, and only approximately 10% arrives at the photosensitive drums 1C and 1K, which are positioned on the downstream side in the rotation direction. Thus, the foreign matter formed from the components stemming from the recording medium 12 on the intermediate transfer belt 8 affects the cleaning blades 7C and 7K little. Accordingly, in the present embodiment, the timing when the fur brush starts rotating is set for each of the image forming units.

Figure 7:
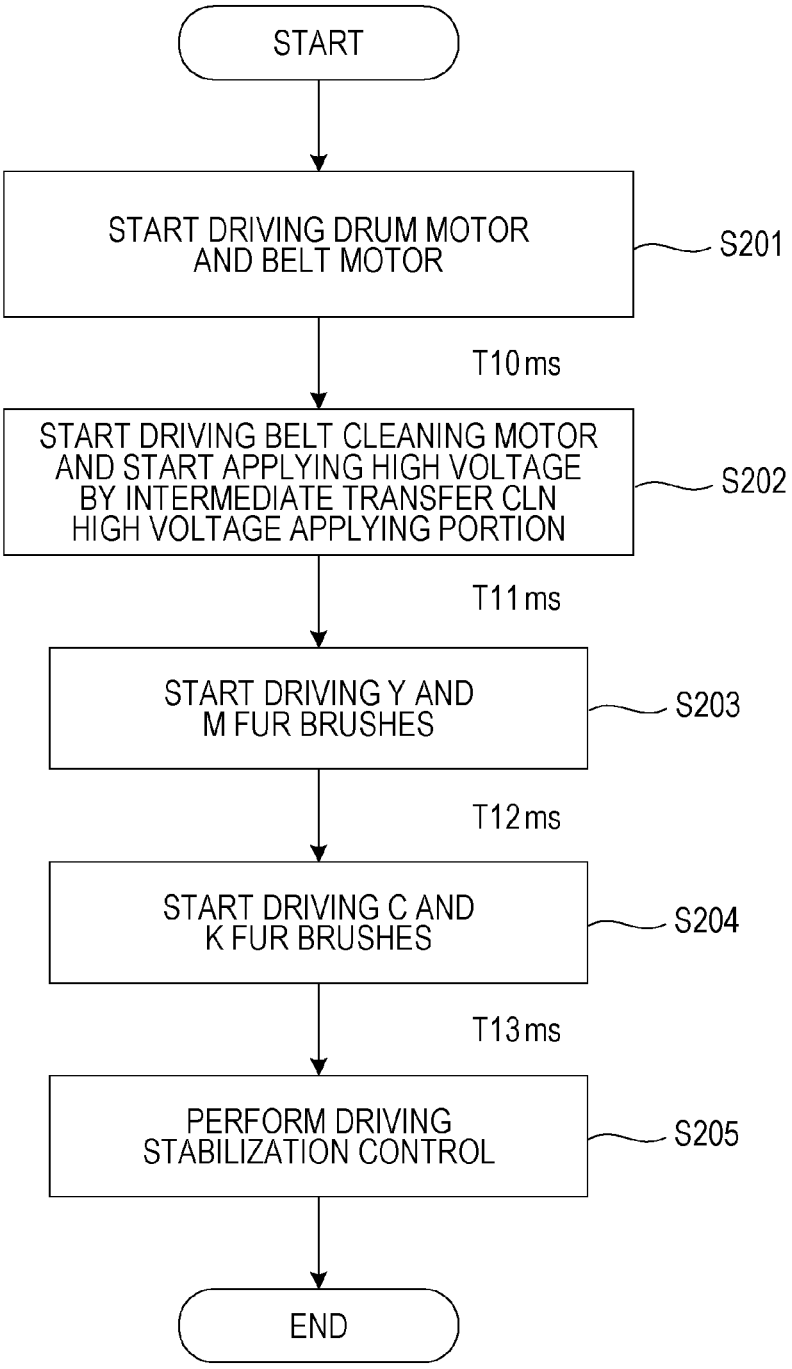
FIG. 7 is a flow chart that illustrates control processing performed by the control portion according to a second embodiment of the present disclosure.

FIG. 7 is a flow chart that illustrates control processing when the CPU 41 performs drive control for the photosensitive drum 1 and fur brush 6. FIG. 8 is a sequence chart that illustrates behaviors of the drum motor 50, cleaning motor 60, and belt motor 70 when the CPU 41 performs the control in accordance with the flow chart illustrated in FIG. 7. In the present embodiment, the photosensitive drum 1 and intermediate transfer belt 8 are configured such that both reach a steady rotation in 500 ms since both start rotating. In the present embodiment, the fur brush 6 is configured such that it reaches a steady rotation in 100 ms since it starts rotating. The image forming apparatus 100 in the present embodiment is configured such that its process speed is 225 mm/sec and foreign matter from the intermediate transfer belt cleaning device 9 arrives at the fur brush 6Y in 400 ms.

As illustrated in FIG. 7, the CPU 41 first starts driving the drum motor 50 and belt motor 70 (S201). In the processing at step S201, the CPU 41 outputs a driving ON signal to each of the drum motor 50 and belt motor 70 to start driving the drum motor 50 and belt motor 70 at the same time. In the image forming apparatus 100, as illustrated in FIG. 8, the driving ON signal is output to each of the drum motor 50 and belt motor 70, so that rotation of the photosensitive drum 1 and rotational drive of the intermediate transfer belt 8 start at the same time. The timing when the driving ON signal is output to each of the drum motor 50 and belt motor 70 and the rotation of the photosensitive drum 1 and rotational drive of the intermediate transfer belt 8 start at the same time is defined as first start timing B1. In the following description, the first start timing B1 is used as the reference (0 ms) in the staring operation.

Next, the CPU 41 proceeds to the processing at step S202 after the elapse of first time 110 (=100 ms) from the processing at step S201. In the processing at step S202, the CPU 41 starts driving the belt cleaning motor 80 and starts applying a high voltage to the upstream fur brush 9A and downstream fur brush 9B by using the intermediate transfer CLN high voltage applying portion 81. Then, the CPU 41 proceeds to processing at step S203 after the elapse of second time T11 (=100 ms) from the processing at step S202. In the processing at step S203, the CPU 41 outputs a driving ON signal to the cleaning motor 60 and starts rotation of the fur brushes 6Y and 6M, which are near the intermediate transfer belt cleaning device 9 in the rotation direction of the intermediate transfer belt 8.

Figure 8:
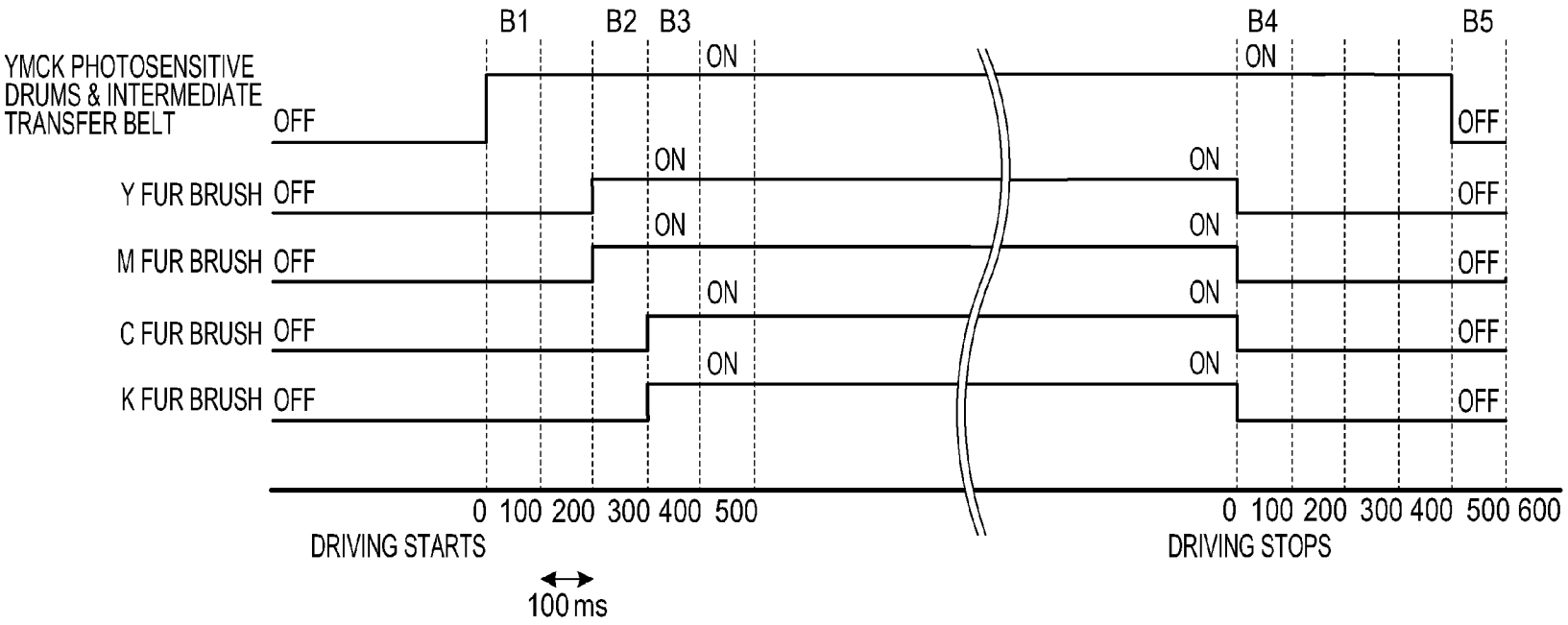
FIG. 8 is a sequence chart that illustrates the control processing performed by the control portion according to the second embodiment of the present disclosure.

In performing the processing at step S203, the CPU 41 outputs the driving ON signal to the cleaning motor 60 and starts rotation of the fur brushes 6Y and 6M at the same time, as illustrated in FIG. 8. The timing when the driving ON signal is output to the cleaning motor 60 and the fur brushes 6Y and 6M start rotating is defined as second start timing B2. In this way, after the elapse of the first time 110 and second time T11 from the processing at step S201, the CPU 41 performs the processing at step S203.

Therefore, the CPU 41 can place a time interval equal to or longer than 200 ms between the initiation of rotation of the photosensitive drum 1 and the initiation of rotation of the fur brush 6. In the case where the fur brushes 6Y and 6M start rotating at the second start timing B2, the value of the ratio of the peripheral speed of the fur brushes 6Y and 6M to that of the photosensitive drums 1Y and 1M is always at or below 2.5. That is, the CPU 41 can place a time interval equal to or longer than the time (=200 ms) required to achieve the state where the value of the ratio of the peripheral speed of the fur brushes 6Y and 6M to that of the photosensitive drums 1Y and 1M is always at or below a predetermined value before the initiation of the rotation of the fur brushes 6Y and 6M. Thus, even when the fur brushes 6Y and 6M rotate faster than the photosensitive drums 1Y and 1M, the image forming apparatus 100 can prevent the surface potential of the photosensitive drums 1Y and 1M from being positively charged by the fur brushes 6Y and 6M.

The CPU 41 starts rotation of the fur brush 6Y at the point in time when 200 ms elapses from the initiation of rotational drive of the intermediate transfer belt 8. Accordingly, the CPU 41 can make the fur brushes 6Y and 6M reach a steady rotation before the elapse of the time it takes components stemming from the recording medium 12 on the intermediate transfer belt 8 to arrive at the fur brush 6Y from the initiation of rotational drive of the intermediate transfer belt 8 (=400 ms). Thus, the CPU 41 can increase the peripheral speed of the fur brush 6Y up to a speed at which sufficient cleaning performance is achieved before foreign matter from the intermediate transfer belt cleaning device 9 arrives at the position of the fur brush 6Y through the intermediate transfer belt 8 and photosensitive drum 1. The first time T10 and second time T11 constitute a start waiting time in the present embodiment.

The CPU 41 proceeds to the processing at step S204 after the elapse of third time T12 (=100 ms). In the processing at step S204, the CPU 41 outputs a driving ON signal to the cleaning motor 60 and starts rotation of the fur brushes 6C and 6K, which are positioned on the downstream side in the rotation direction of the intermediate transfer belt 8.

In performing the processing at step S204, the CPU 41 outputs the driving ON signal to the cleaning motor 60 and starts rotation of the fur brushes 6C and 6K at the same time, as illustrated in FIG. 8. The timing when the driving ON signal is output to the cleaning motor 60 and the fur brushes 6C and 6K start rotating is defined as third start timing B3. In this way, after the elapse of third time T12 from the processing at step S203, the CPU 41 performs the processing at step S204.

By starting the rotation of the fur brushes 6C and 6K at the third start timing B3, the CPU 41 can make the peripheral speed of the photosensitive drums 1C and 1K at the third start timing B3 higher than the peripheral speed of the photosensitive drums 1Y and 1M at the second start timing B2. That is, the CPU 41 can make the peripheral speed of the photosensitive drums 1C and 1K when the fur brushes 6C and 6K start rotating high and can more reliably prevent the surface potential of the photosensitive drums 1C and 1K from being positively charged. In the configuration according to the first embodiment, the surface potential of the photosensitive drums 1C and 1K is −9 V to +1 V. In the configuration according to the present embodiment, the surface potential of the photosensitive drums 1C and 1K can be −10 V to 0 V.

In the case where the fur brushes 6C and 6K start rotating at the third start timing B3, the value of the ratio of the peripheral speed of the fur brushes 6C and 6K to that of the photosensitive drums 1C and 1K is always at or below 2.5. Thus, even when the fur brushes 6C and 6K rotate faster than the photosensitive drums 1C and 1K, the image forming apparatus 100 can prevent the surface potential of the photosensitive drums 1C and 1K from being positively charged by the fur brushes 6C and 6K.

After the processing at step S204, the CPU 41 ends the processing relating to driving of the photosensitive drum 1 and fur brush 6. After the elapse of fourth time T13, the CPU 41 executes control for stabilizing the driving of the photosensitive drum 1 and the driving of the intermediate transfer belt 8 (S205). Then, the CPU 41 performs various processing relating to image formation.

Next, control processing performed by the CPU 41 when it stops the photosensitive drum 1 and fur brush 6 is described with reference to the sequence chart in FIG. 8. As in the first embodiment, the cleaning motor 60 in the present embodiment is a DC motor and stops after it rotates by only the amount corresponding to moment of inertia during driving after it is electrically turned off. The cleaning motor 60 in the present embodiment is configured such that 300 ms is needed as first stop time S1 taken to stop in the state where the driving torque of the fur brush 6 is low and the moment of inertia of the DC motor is the largest.

As in the first embodiment, the drum motor 50 is a stepping motor, and it stops after it rotates by only the amount corresponding to moment of inertia of the stepping motor after it is electrically turned off. The drum motor 50 in the present embodiment is configured such that 200 ms is needed as second stop time S2 taken to stop the photosensitive drum 1.

In consideration of the above, the CPU 41 determines the timing when it outputs the driving OFF signal to each of the drum motor 50 and cleaning motor 60. For example, to end an image forming operation and stop, the CPU 41 first outputs the driving OFF signal to the cleaning motor 60. As illustrated in FIG. 8, the CPU 41 outputs the driving OFF signal to the cleaning motor 60 and stops rotation of all of the fur brushes 6Y, 6M, 6C, and 6K at the same time. The timing when the driving OFF signal is output to the cleaning motor 60 and a stopping operation for all the fur brushes 6 starts is defined as first stop timing B4. In the following description, the first stop timing B4 is used as the reference (0 ms) in the stopping operation.

Next, because the first stop time S1 (=300 ms) is needed to stop the fur brush 6 at maximum, the CPU 41 outputs the driving OFF signal to the drum motor 50 and belt motor 70 after the elapse of 300 ms or more from the first stop timing B4. In the present embodiment, the CPU 41 outputs the driving OFF signal to the drum motor 50 and belt motor 70 at the point in time when 400 ms elapses from the first stop timing B4. The timing when the driving OFF signal is output to the drum motor 50 and belt motor 70 and the stopping operation for the photosensitive drum 1 and intermediate transfer belt 8 starts is defined as second stop timing B5.

The CPU 41 can prevent a state where the fur brush 6 is rotating while the photosensitive drum 1 is at rest by starting the stopping operation for the photosensitive drum 1 at the second stop timing B5. Thus, the image forming apparatus 100 can prevent the photosensitive drum 1 from being rubbed with the fur brush 6 locally when the photosensitive drum 1 and fur brush 6 are at rest and can reduce the appearance of memory on the photosensitive drum 1.

In this configuration, the image forming units 200Y and 200M, which are disposed on the upstream side in the rotational drive direction of the intermediate transfer belt 8 and in which the rotational drive of their fur brushes are started at the second start timing B2, constitute a first image forming unit. The image forming units 200C and 200K, which are disposed on the downstream side in the rotational drive direction with respect to the image forming units 200Y and 200M and in which the rotational drive of their fur brushes are started at the third start timing B3, constitute a second image forming unit. The number of units constituting the first image forming unit and the number of units constituting the second image forming units may not be the same. For example, the image forming unit 200Y may constitute the first image forming unit, and the image forming units 200M, 200C, and 200K may constitute the second image forming unit. As previously described, because approximately 30% of the components stemming from the recording medium 12 arrives at the image forming unit 200M, it is useful that the first image forming unit and second image forming unit are configured as in the present embodiment.

In this way, the image forming apparatus 100 in the present embodiment first starts rotation of the fur brushes 6Y and 6M after starting rotation of the photosensitive drums 1. Then, the image forming apparatus 100 starts rotation of the fur brushes 6C and 6K after starting rotation of the fur brushes 6Y and 6M. Accordingly, the image forming apparatus 100 can more reliably reduce the occurrence in which the photosensitive drums 1C and 1K are positively charged by the fur brushes 6C and 6K.

OTHER EMBODIMENTS

In the above-described embodiments, the image forming apparatus 100 starts rotation such that the fur brush 6Y reaches a steady rotation after the rotational drive of the intermediate transfer belt 8 is started and before foreign matter on the intermediate transfer belt 8 arrives. Other forms may also be used. The fur brush 6 can sufficiently clean the photosensitive drum 1 when it rotates at a predetermined speed or more, even if the predetermined speed is below the peripheral speed in steady rotation. Thus, the image forming apparatus 100 may start rotation of the fur brush 6Y at a timing that enables the fur brush 6Y to be accelerated to a speed at which no cleaning defects occur after rotational drive of the intermediate transfer belt 8 is started and before foreign matter on the intermediate transfer belt 8 arrives.

In the above-described embodiments, the image forming apparatus 100 is configured such that the stopping operation for the photosensitive drum 1 is started after the stopping operation for the fur brush 6 is started. Other forms may also be used. The surface potential of the photosensitive drum 1 may be smaller than the potential change illustrated in FIG. 3, depending on the status of the fur brush 6. Specifically, in the case where some toner is applied to the fur brush 6, even when the photosensitive drum 1 is rubbed with the fur brush 6, the occurrence in which it is positively charged can be reduced. Thus, by using a process for ejecting some toner from the developing device 4 to the fur brush 6, the image forming apparatus 100 can avoid the photosensitive drum 1 from being positively charged even when the stopping operation for the photosensitive drum 1 is started before the stopping operation for the fur brush 6 is started.

The process for ejecting some toner from the developing device 4 to the fur brush 6 is described in detail below. The image forming apparatus 100 can eject some toner by repeating a series of operations of driving the developing sleeve in the developing device 4 for a short time and stopping it in the state where the charging potential and developing potential are 0 V. One example behavior of the developing device 4 may be repeating the operation of driving for 100 ms and stopping for 50 ms three times.

In the case where the toner is applied to the fur brush 6, in the image forming apparatus 100, even when the photosensitive drum 1 is at rest, the surface potential of the photosensitive drum 1 is not positively charged as long as the time for which the fur brush 6 is driven is at or below 300 ms. Thus, the image forming apparatus 100 can be configured such that the stopping operation for the photosensitive drum 1 is started before the stopping operation for the fur brush 6 is started. With this configuration, the image forming apparatus 100 can quickly stop the photosensitive drum 1 after image formation, and this leads to an extended life of the photosensitive drum 1.

The image forming apparatus 100 in the above-described embodiments includes the fur brush 6 as a cleaning rotator. However, other forms may also be used. For example, a rotatable rolling member may also be used.

The image forming apparatus 100 in the above-described embodiments includes the drum motor 50 and cleaning motor 60 independently. Other forms may also be used. For example, the image forming apparatus 100 includes the drum motor 50 and cleaning motor 60 by using a single driving source. In this case, it is useful that the image forming apparatus 100 is configured such that the driving source is connected to a mechanism capable of switching power transmission, such as a clutch, to enable controlling the drum motor 50 and cleaning motor 60 independently.

The image forming apparatus 100 in the first and second embodiments is configured such that a toner image is transferred to the recording medium 12 by the secondary transfer roller 10. Other forms may also be used. For example, the image forming apparatus 100 may be configured such that a toner image is transferred to the recording medium 12 by the primary transfer roller 5 in the image forming unit 200.

The image forming apparatus according to the above-described embodiments is applicable to a copier, printer, facsimile machine, multifunction apparatus having the plurality of functions, and other similar apparatuses.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2015-144847 filed Jul. 22, 2015, which is hereby incorporated by reference herein in its entirety.

What is claimed is:

1. An image forming apparatus comprising:

a first image forming portion including a first image-bearing member, a toner image forming portion configured to form a first toner image on the first image-bearing member, and a first cleaning member being rotatable and configured to clean the first toner image on the first image-bearing member by rotation;

a second image forming portion including a second image-bearing member, a toner image forming portion configured to form a second toner image on the second image-bearing member, and a second cleaning member being rotatable and configured to clean the second toner image on the second image-bearing member by rotation; and a control portion configured to control a rotation start timing for each of the first and second cleaning members such that when an image forming operation starts after an image forming signal for forming an image on a recording medium is input, an output of a signal for starting the rotation of the first cleaning member and an output of a signal for starting the rotation of the second cleaning member are different.

2. The image forming apparatus according to claim 1, further comprising:

a third image forming portion including a third image-bearing member, a toner image forming portion configured to form a third toner image on the third image-bearing member, and a third cleaning member being rotatable and configured to clean the third toner image on the third image-bearing member by rotation; and a fourth image forming portion including a fourth image-bearing member, a toner image forming portion configured to form a fourth toner image on the fourth image-bearing member, and a fourth cleaning member being rotatable and configured to clean the fourth toner image on the fourth image-bearing member by rotation, wherein a signal for starting the rotation of the third cleaning member and the signal for starting the rotation of the first cleaning member are output at an identical timing, and a signal for starting the rotation of the fourth cleaning member and the signal for starting the rotation of the second cleaning member are output at an identical timing.

3. The image forming apparatus according to claim 2, wherein signals for starting rotations of all the image-bearing members are output at an identical timing.

4. The image forming apparatus according to claim 1, wherein the first cleaning member starts rotating after the first image-bearing member starts rotating, and the second cleaning member starts rotating after the second image-bearing member starts rotating.

5. The image forming apparatus according to claim 1, wherein a signal for starting rotation of the first image-bearing member and a signal for starting rotation of the second image-bearing member are output at an identical timing.

6. The image forming apparatus according to claim 1, wherein a signal for stopping the rotation of the first cleaning member and a signal for stopping the rotation of the second cleaning member are output at an identical timing.

7. The image forming apparatus according to claim 6, wherein the first image-bearing member stops rotating after the first cleaning member stops rotating.

8. The image forming apparatus according to claim 1, further comprising an intermediate transfer member being rotatable and bearing the first toner image transferred from the first image-bearing member and the second toner image transferred from the second image-bearing member, wherein a signal for starting rotation of the first image-bearing member, a signal for starting rotation of the second image-bearing member, and a signal for starting rotation of the intermediate transfer member are output at an identical timing.

9. The image forming apparatus according to claim 8, wherein in a direction of movement of the intermediate transfer member, the first image-bearing member is disposed at more upstream side than the second image-bearing member, and the time of an output of a signal for starting the rotation of the first cleaning member is earlier than the time of an output of a signal for starting the rotation of the second cleaning member.

10. The image forming apparatus according to claim 1, wherein each of the first cleaning member and the second cleaning member is a fur brush.

11. An image forming apparatus comprising:

a first image forming portion including a first image-bearing member, a toner image forming portion configured to form a first toner image on the first image-bearing member, and a first cleaning member being rotatable and configured to clean the first toner image on the first image-bearing member by rotation;

a second image forming portion including a second image-bearing member, a toner image forming portion configured to form a second toner image on the second image-bearing member, and a second cleaning member being rotatable and configured to clean the second toner image on the second image- bearing member by rotation; and a control portion configured to control a rotation start timing for each of the first and second cleaning members such that when an image forming operation starts after an image forming signal for forming an image on a recording medium is input, a timing of starting the rotation of the first cleaning member and a timing of starting the rotation of the second cleaning member are different.

12. The image forming apparatus according to claim 11, further comprising:

a third image forming portion including a third image-bearing member, a toner image forming portion configured to form a third toner image on the third image-bearing member, and a third cleaning member being rotatable and configured to clean the third toner image on the third image-bearing member by rotation; and a fourth image forming portion including a fourth image-bearing member, a toner image forming portion configured to form a fourth toner image on the fourth image-bearing member, and a fourth cleaning member being rotatable and configured to clean the fourth toner image on the fourth image-bearing member by rotation, wherein the rotation of the third cleaning member and the rotation of the first cleaning member start at an identical timing, and the rotation of the fourth cleaning member and the rotation of the second cleaning member start at an identical timing.

13. The image forming apparatus according to claim 12, wherein signals for starting rotations of all the image-bearing members are output at an identical timing.

14. The image forming apparatus according to claim 11, wherein the first cleaning member starts rotating after the first image-bearing member starts rotating, and the second cleaning member starts rotating after the second image-bearing member starts rotating.

15. The image forming apparatus according to claim 11, wherein a signal for starting rotation of the first image-bearing member and a signal for starting rotation of the second image-bearing member are output at an identical timing.

16. The image forming apparatus according to claim 11, wherein the rotation of the first cleaning member and the rotation of the second cleaning member stop at an identical timing.

17. The image forming apparatus according to claim 16, wherein the first image-bearing member stops rotating after the first cleaning member stops rotating.

18. The image forming apparatus according to claim 11, further comprising an intermediate transfer member being rotatable and bearing the first toner image transferred from the first image-bearing member and the second toner image transferred from the second image-bearing member, wherein a signal for starting rotation of the first image-bearing member, a signal for starting rotation of the second image-bearing member, and a signal for starting rotation of the intermediate transfer member are output at an identical timing.

19. The image forming apparatus according to claim 18, wherein in a direction of movement of the intermediate transfer member, the first image-bearing member is disposed at more upstream side than the second image-bearing member, and the time of an output of a signal for starting the rotation of the first cleaning member is earlier than the time of an output of a signal for starting the rotation of the second cleaning member.

20. The image forming apparatus according to claim 11, wherein each of the first cleaning member and the second cleaning member is a fur brush.

21. An image forming apparatus comprising:

a first image forming portion including a first image-bearing member, a toner image forming portion configured to form a first toner image on the first image-bearing member, and a first cleaning member being rotatable and configured to clean the first toner image on the first image-bearing member by rotation;

a second image forming portion including a second image-bearing member, a toner image forming portion configured to form a second toner image on the second image-bearing member, and a second cleaning member being rotatable and configured to clean the second toner image on the second image- bearing member by rotation;

a first driving motor configured to drive the first cleaning member;

a second driving motor configured to drive the second cleaning member; and a control portion configured to control a start timing for each of the first and second driving motor such that when an image forming operation starts after an image forming signal for forming an image on a recording medium is input, a timing of starting the drive of the first driving motor and a timing of starting the drive of the second driving motor are different.

22. The image forming apparatus according to claim 21, further comprising:

a third image forming portion including a third image-bearing member, a toner image forming portion configured to form a third toner image on the third image-bearing member, and a third cleaning member being rotatable and configured to clean the third toner image on the third image-bearing member by rotation;

a fourth image forming portion including a fourth image-bearing member, a toner image forming portion configured to form a fourth toner image on the fourth image-bearing member, and a fourth cleaning member being rotatable and configured to clean the fourth toner image on the fourth image-bearing member by rotation;

a third driving motor configured to drive the third cleaning member; and a fourth driving motor configured to drive the fourth cleaning member, wherein a drive of the third cleaning member and a drive of the first cleaning member starts at an identical timing, and a drive of the fourth cleaning member and a drive of the second cleaning member starts at an identical timing.

23. The image forming apparatus according to claim 22, wherein signals for starting rotations of all the image-bearing members are output at an identical timing.

24. The image forming apparatus according to claim 21, wherein the first driving motor starts driving after the first image-bearing member starts rotating, and the second driving motor starts driving after the second image-bearing member starts rotating.

25. The image forming apparatus according to claim 21, wherein a signal for starting rotation of the first image-bearing member and a signal for starting rotation of the second image-bearing member are output at an identical timing.

26. The image forming apparatus according to claim 21, wherein a drive of the first driving motor and a drive of the second driving motor member stop at an identical timing.

27. The image forming apparatus according to claim 26, wherein the first image-bearing member stops rotating after the first driving motor stops driving.

28. The image forming apparatus according to claim 21, further comprising an intermediate transfer member being rotatable and bearing the first toner image transferred from the first image-bearing member and the second toner image transferred from the second image-bearing member, wherein a signal for starting rotation of the first image-bearing member, a signal for starting rotation of the second image-bearing member, and a signal for starting rotation of the intermediate transfer member are output at an identical timing.

29. The image forming apparatus according to claim 28, wherein in a direction of movement of the intermediate transfer member, the first image-bearing member is disposed at more upstream side than the second image-bearing member, and the time of an output of a signal for starting the rotation of the first cleaning member is earlier than the time of an output of a signal for starting the rotation of the second cleaning member.

30. The image forming apparatus according to claim 21, wherein each of the first cleaning member and the second cleaning member is a fur brush.

31. The image forming apparatus according to claim 21, wherein each of the first driving motor and the second driving motor is a DC motor.

32. An image forming apparatus comprising:

a first image forming portion including a first image-bearing member, a toner image forming portion configured to form a first toner image on the first image-bearing member, and a first cleaning member being rotatable and configured to clean the first toner image on the first image-bearing member by rotation;

a second image forming portion including a second image-bearing member, a toner image forming portion configured to form a second toner image on the second image-bearing member, and a second cleaning member being rotatable and configured to clean the second toner image on the second image-bearing member by rotation;

a first driving portion configured to drive the first cleaning member;

a second driving portion configured to drive the second cleaning member; and a control portion configured to control a start timing for each of the first and second driving portion such that when an image forming operation starts after an image forming signal for forming an image on a recording medium is input, a timing at which a signal for starting the rotation of the first cleaning member is input to the first driving portion and a timing at which a signal for starting the rotation of the second cleaning member is input to the second driving portion are different.

33. The image forming apparatus according to claim 32, further comprising:

a third image forming portion including a third image-bearing member, a toner image forming portion configured to form a third toner image on the third image-bearing member, and a third cleaning member being rotatable and configured to clean the third toner image on the third image-bearing member by rotation;

a fourth image forming portion including a fourth image-bearing member, a toner image forming portion configured to form a fourth toner image on the fourth image-bearing member, and a fourth cleaning member being rotatable and configured to clean the fourth toner image on the fourth image-bearing member by rotation;

a third driving portion configured to drive the third cleaning member; and a fourth driving portion configured to drive the fourth cleaning member, wherein a timing of a signal for starting the rotation of the first cleaning member is input to the first driving portion and a timing of a signal for starting the rotation of the third cleaning member is input to the third driving portion are at an identical timing, and a timing at which a signal for starting the rotation of the second cleaning member is input to the second driving portion and a timing at which a signal for starting the rotation of the fourth cleaning member is input to the fourth driving portion are at an identical timing.

34. The image forming apparatus according to claim 33, wherein signals for starting rotations of all the image-bearing members are output at an identical timing.

35. The image forming apparatus according to claim 32, wherein the first driving portion starts driving after the first image-bearing member starts rotating, and the second driving portion starts driving after the second image-bearing member starts rotating.

36. The image forming apparatus according to claim 32, wherein a signal for starting rotation of the first image-bearing member and a signal for starting rotation of the second image-bearing member are output at an identical timing.

37. The image forming apparatus according to claim 32, wherein a drive of the first driving portion and a drive of the second driving portion member stop at an identical timing.

38. The image forming apparatus according to claim 37, wherein the first image-bearing member stops rotating after the first driving motor stops driving.

39. The image forming apparatus according to claim 32, further comprising an intermediate transfer member being rotatable and bearing the first toner image transferred from the first image-bearing member and the second toner image transferred from the second image-bearing member, wherein a signal for starting rotation of the first image-bearing member, a signal for starting rotation of the second image-bearing member, and a signal for starting rotation of the intermediate transfer member are output at an identical timing.

40. The image forming apparatus according to claim 39, wherein in a direction of movement of the intermediate transfer member, the first image-bearing member is disposed at more upstream side than the second image-bearing member, and the time of an output of a signal for starting the rotation of the first cleaning member is earlier than the time of an output of a signal for starting the rotation of the second cleaning member.

41. The image forming apparatus according to claim 32, wherein each of the first cleaning member and the second cleaning member is a fur brush.

42. The image forming apparatus according to claim 32, wherein each of the first driving portion and the second driving portion includes a DC motor.

* * * * *